United States Patent [19]

Ammann et al.

[11] 4,098,455

[45] Jul. 4, 1978

[54] ROTARY SEAL DISTRIBUTOR MEMBER FOR A CENTRIFUGE

[75] Inventors: David W. Ammann, Lindenhurst; David A. Bates, Libertyville; Daniel B. Granzow, Arlington Heights, all of Ill.

[73] Assignee: Baxter Travenol Laboratories, Inc., Deerfield, Ill.

[21] Appl. No.: 782,490

[22] Filed: Mar. 29, 1977

[51] Int. Cl.[2] ..... B04B 7/00

[52] U.S. Cl. ..... 233/1 A; 233/26; 285/190; 239/264

[58] Field of Search ..... 233/1 R, 1 A, 1 D, 14 R, 233/14 A, 26, 25, 27, 17; 239/264, 222; 277/51, 91; 285/190, 137 R

[56] References Cited

U.S. PATENT DOCUMENTS

| | | | |
|---|---|---|---|
| 2,698,664 | 1/1955 | Freeman | 239/264 X |
| 3,527,402 | 9/1970 | Kobetsky | 233/1 A |
| 3,561,672 | 2/1971 | Schlutz et al. | 233/17 |

FOREIGN PATENT DOCUMENTS

| | | | |
|---|---|---|---|
| 470,723 | 1/1929 | Fed. Rep. of Germany | 233/1 A |

*Primary Examiner*—George H. Krizmanich
*Attorney, Agent, or Firm*—Henry W. Collins; Paul C. Flattery; Garrettson Ellis

[57] ABSTRACT

A rotary distributor seal for a rotary centrifuge which comprises a tubular housing having sealed ends, a relatively rotatable fluid conveying apertured spindle coaxially mounted in the housing, and several resilient, spaced ring seals positioned about the spindle to seal the annular space between the spindle and the housing, and to subdivide it into several annular chambers. Ports communicate with the chambers to provide fluid flow from the ports through the separate chambers and through the spindle. In accordance with this invention, support members are positioned in alternate, spaced chambers between pairs of ring seals to prevent collapse of the ring seal pairs together.

4 Claims, 8 Drawing Figures

FIG. 1
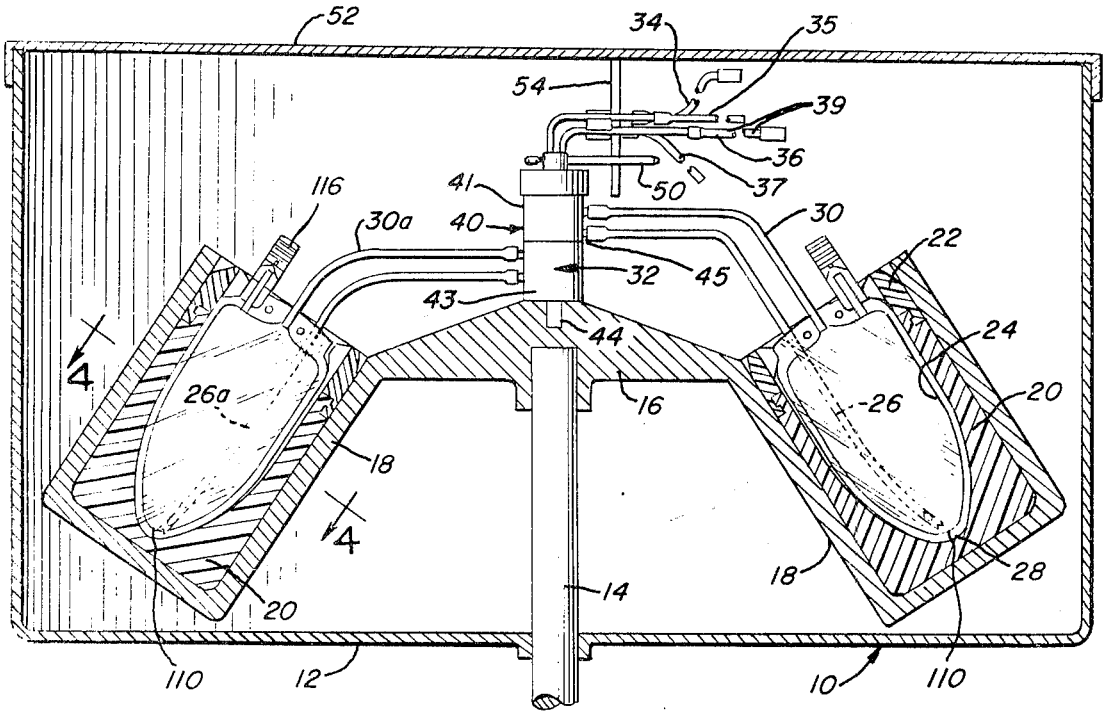
FIG. 3
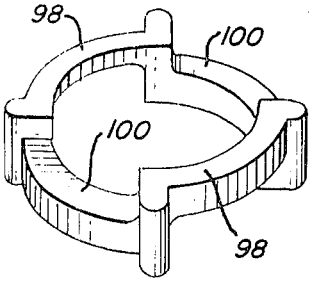
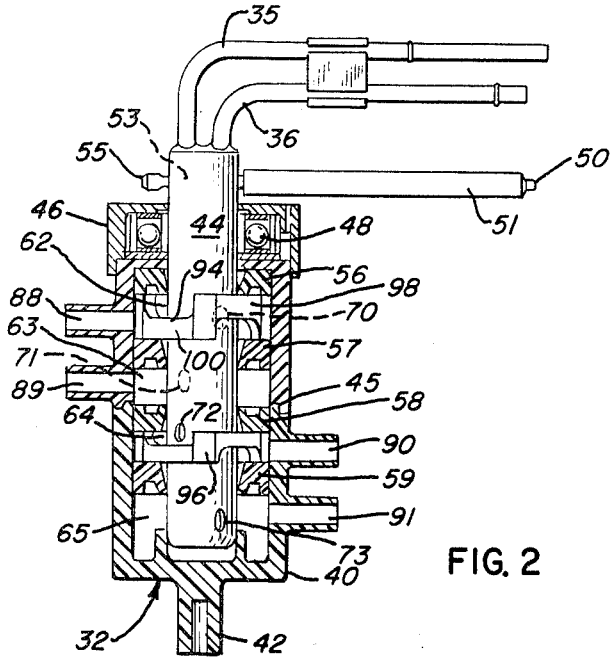
FIG. 2

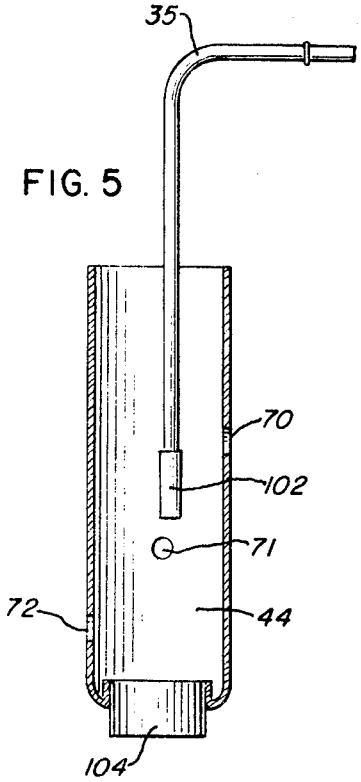
FIG. 5
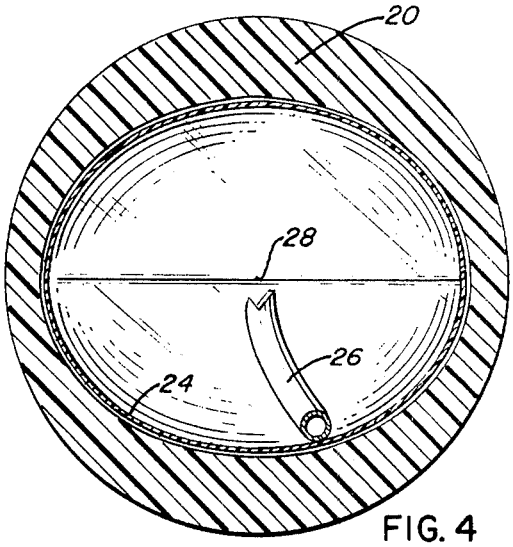
FIG. 4
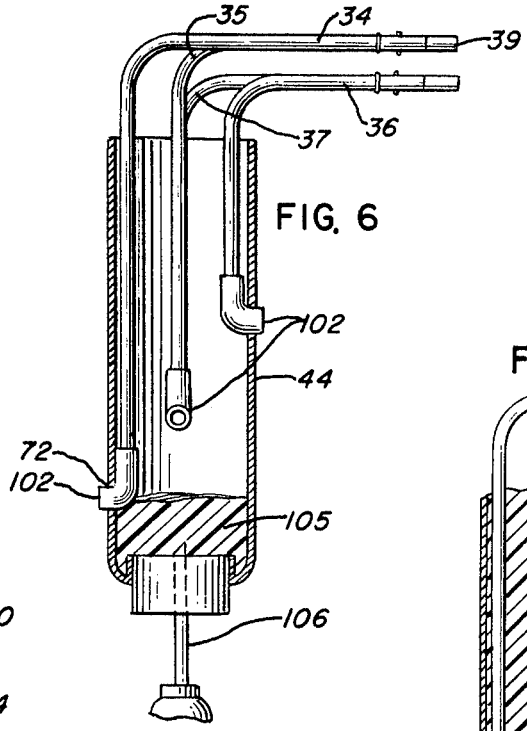
FIG. 6
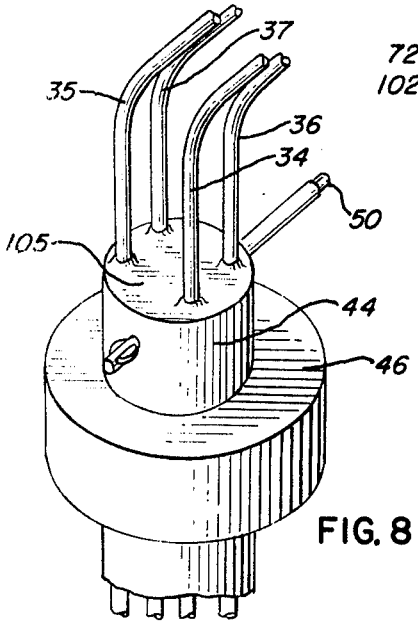
FIG. 8
FIG. 7
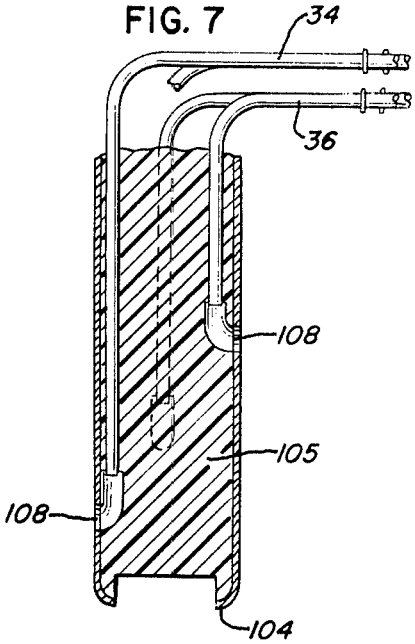

ROTARY SEAL DISTRIBUTOR MEMBER FOR A CENTRIFUGE

BACKGROUND OF THE INVENTION

In U.S. Pat. Nos. 3,347,454; 3,672,564; and 3,719,406, centrifuges are disclosed utilizing collapsible centrifuge bags for the continuous washing of blood cells positioned in the bags during the centrifuge operation. To provide a continuous connection with the exterior while the centrifuge is rotating, a rotary seal distributor member is disclosed including an apertured spindle coaxially mounted in a housing and projecting from its end, with several spaced ring seals positioned about the spindle. The annular spaces which are defined by the ring seals serve as separate chambers through which fluid flows either into or out of the system. For example, two separate washing systems may be routed through the same rotary seal structure, as illustrated in the last-cited patent.

The rotary distribution seal of the prior art has occasionally encountered some functional disadvantages. For example, when a substantial pressure differential exists between solution passing into the system through the rotary distributor member, as compared with wash solution passing out of the system through the same distributor member, a pressure differential exists between different annular chambers separated by the ring seals. This can result in leakage between the respective chambers, which is distinctly undesirable, particularly when two different types of blood are being simultaneously washed in a centrifuge system.

Also, difficulties have been encountered in the assembly of the flow tubes in the spindle of the rotary seal member to provide reliable leak-proof operation.

In accordance with this invention, an improved rotary seal member is provided in which leakage problems encountered by previous rotary seal members have been eliminated, while still providing a structure having great ease of assembly and reliable operation.

DESCRIPTION OF THE INVENTION

The rotary distributor seal member of this invention comprises a tubular housing having sealed ends, a relatively rotatable, fluid conveying, apertured spindle coaxially mounted in the housing and projecting from an end thereof, and a plurality of resilient, spaced ring seals positioned about the spindle to seal the annular space between the spindle and the inner surface of the housing, and to subdivide the annular space into a plurality of axially spaced chambers. Ports communicate with the axially-spaced chambers through the housing to provide fluid flow paths from the ports through the separate chambers, and from there through the spindle by means of apertures therein. The spindle, in turn, carries tubes which communicate with the exterior. Thus, a continuous flow path is provided, despite the rotation of the tubular housing, between the ports on the tubular housing, which can be in communication with the centrifuge cups or bags in them and connections outside of the centrifuge.

In accordance with this invention, support members are positioned in alternate, spaced annular chambers between pairs of rings, to prevent collapse of the rings paired together. While a single support member between a single pair of rings may be used for this purpose, the specific embodiment shows that a pair of support members in alternate, spaced chambers of a rotary seal member having four or more chambers is preferred.

The support member comprises a rigid ring positioned about the spindle and spaced from it. A first, opposed pair of sections of the ring occupies a first plane which is transverse to the axis of the spindle. A second, opposed pair of sections of the ring occupies a second transverse plane, and is connected to the first pair of sections, the second plane being axially spaced from the first plane, so that flow paths through and around the ring are provided, to prevent interference by the ring to fluid flow in the chamber it occupies. One of the pairs of sections bears against one ring seal, while the other of the pairs of sections bears against the other ring seal, between which the rigid ring is positioned. Thus, the rigid ring support member prevents the collapse of the ring seals together, in the event of a significant pressure differential in which the annular chambers which do not have a rigid ring are subjected to a higher pressure than the chambers which do have such a ring.

In other words, it is preferred to place the rigid rings in annular chambers of the rotary distribution seal which receive effluent materials from the centrifuge chambers. Correspondingly, the annular spaces which do not contain a rigid ring are connected to receive fresh fluid to be passed to the centrifuge chambers. Generally, the fresh fluid which is being pumped into the centrifuge will have a higher pressure than the effluent fluid, due to the natural pressure drop of the system, creating the resulting pressure differential between the chambers.

In the drawings,

FIG. 1 is an elevational view of part of a centrifuge system utilizing the rotary distributor seal of this invention.

FIG. 2 is an enlarged, partial longitudinal sectional view of the rotary distributor seal of this invention.

FIG. 3 is a perspective view of the rigid ring support member in the rotary seal of this invention.

FIG. 4 is a sectional view taken along line 4—4 of FIG. 1.

FIG. 5 is a sectional view of the spindle of this invention shown in an initial stage of construction.

FIGS. 6 and 7 are sectional view which show consecutive steps in the manufacture of the spindle utilized in the specific embodiment of this invention.

FIG. 8 is a perspective view of the upper portion of the completed spindle utilized herein.

Referring in FIG. 1, a centrifuge 10 is shown comprising a housing 12, a rotating shaft 14, and cross arm 16 which carries a plurality of centrifuge cups 18, specifically two cups in the particular instance shown.

Centrifuge 10 may be of the general purpose type, but is specifically adapted for washing of blood by means of the apparatus described below.

Each centrifuge cup 18 is shown to be holding an inner cup 20 which, in turn, carries a cap member 22 on its mouth end. Within the cup and cap member is a collapsible plastic bag 24 for receiving blood cells for washing. A pair of flow tubes pass through the periphery of bag 12 into communication with the interior thereof. Flow inlet tubes 26, **26*a* extend essentially the length of the interior of the bag to open near the radiallyoutward apex 28, while flow tubes 30, 30*a*** terminate at the radially-inward end of the bag.

Rotary seal 32 is provided to permit the continuous distribution of fluid to the centrifuging system from tubing 34, 35, 36 and 37 to provide four independent, separate flow paths through the rotary seal between tubes 34 through 37 and tubes 26, 26a, 30 and 30a.

Referring to FIGS. 2 and 3, rotary seal 32 is shown in greater detail.

Rotary seal member 32 is shown to define a tubular housing 40 having a lower protrusion 42 which may be rectangular in shape or of other non-circular cross section, to fit in a mating hole 44 of the centrifuge cross arm 16 so that housing member 40 rotates with the centrifuge.

Housing 40 may be made of a pair of tubular members 41, 43 which abuts together at annular, stepped junction 45 as shown.

Seal member 32 also defines spindle 44, which is secured to cap 46 in rotational manner by means of a ball bearing 48. Cap 46 in turn is secured to housing 40, so that the housing 40 and spindle 44 are in relatively rotating relationship.

The upper end of spindle 44 carries a cross bar 50 which may pass through the spindle. Cross bar 50 carries protective sleeve 51, which also serves as a retention means to prevent bar 50 from sliding through aperture 53 of spindle 44. At the other end, bar 50 has a flattened head 55 produced by cold heading or the like to cause the bar to be retained in aperture 53.

Casing 12 carries a cross member 52 across its top which, in turn, carries a depending member 54 positioned to engage cross bar 50. Thus, as the centrifuge begins to rotate, cross bar 50 engages depending member 54, preventing the rotation of spindle 44.

A plurality of ring seals 56, 57, 58 and 59 are positioned between spindle 44 and the inner surface of housing 40, to provide seals about spindle 44, and to subdivide the annular space between spindle 44 and housing 40 into a plurality of separate chambers 62, 63, 64 and 65, which chambers are sealed from each other by the ring seals. Positioned to communicate with each chamber are apertures 70, 71, 72, and 73, to provide communication between the interior of the spindle and each separate annular chamber. One each of tubes 34, 35, 36 and 37 communicate in a sealed manner to be described below with each of the apertures 70 through 73, to provide four independent flow paths through spindle 44.

Ports 88, 89, 90, and 91 provide communication through the lateral wall of housing 40, each to a separate annular chamber 62 through 65, so that each of the ports 88 through 91 represents an extension of the independent flow paths described above. Tubes 26, 26a, 30 and 30a communicate with ports 88 through 91 to provide an extension of the four independent flow paths, two leading to centrifuge bag 24, and two others leading to centrifuge bag 24a, one each for use as a fluid inlet and the others for fluid outlets.

In accordance with this invention, support members 94, 96 are positioned in alternate, spaced chambers 62, 64 between a pair of ring seals to prevent collapse of the ring seal pairs together.

Thus, chambers 63 and 65 may be part of the respective fluid inlet lines, being in flow communication respectively with inlet tubes 26, 26a. These chambers will be expected to exhibit a higher pressure during operation than the pressure in outlet chambers 62, 64, which are in flow communication with outlet lines 30, 30a. The presence of support members 94, 96 prevents the undue stretching and collapsing of, respectively, ring seals 56 and 57 and ring seals 58 and 59 together with the resultant possibility of seal failure and cross mixing of the contents of the respective annular chambers.

Support members 94, 96 comprise a rigid ring positioned about spindle 44 and preferably spaced from it. A first opposed pair of sections 98 of members 94, 96 occupies a first plane which is generally transverse to the axis of spindle 44. A second opposed pair of sections 100 of members 94, 96 is spaced between the first pair of sections 98, and occupies a second transverse plane, to provide a structure which simultaneously supports the ring seals between which it is placed, while permitting flow of fluid around and through the support members, so that annular chambers 62, 64 are not occluded.

FIGS. 5 through 8 show successive steps of the assembling of tubes 34 through 37 in the spindle 44. The major portions of tubes 34 through 37 are rigid, being preferably made of stainless steel, ABS plastic, or the like, although they may be connected to flexible tubing 39 at their ends.

The problem is to insert the tube such as tube 35 longitudinally into the hollow spindle 44, and then to make a sealing connection with an aperture (for example aperture 72) which involves making an angled turn and sealing.

This is accomplished by means of flexible sleeve 102, which is placed on the end of the tube 35 as shown in FIG. 5. Sleeve 102 may be made of polyvinyl chloride. Thereafter, tube 35 is inserted into spindle 44, and elastic tube 102 is drawn through aperture 72 as shown in FIG. 6. This process is repeated for each of the tubes 34 through 37, after which the interior of spindle 44 is filled through bottom aperture 104 with a potting compound such as room temperature vulcanizable silicone elastomer 105, as shown in FIG. 7, using a syringe 106. Then a plug may be inserted in aperture 104, at least until elastomer 105 is cured.

After curing of the potting compound, the flexible sleeves 102 are removed by pulling them out through the respective apertures, leaving behind a channel 108, which sealingly communicates between each aperture 70 through 73, and its associated flow tube 34 through 37, as shown in FIG. 7. This permits the use of rigid access tubes, while providing a well-sealed connection between the spindle apertures and the tubes. The rigid tubes avoid kinking and constriction of flow, which might be found in flexible plastic tubes.

The vinyl chloride tubes 102 are particularly nonadherent to the silicone potting compound, and thus may be easily removed by pulling.

The above has been offered for illustrative purposes only, and is not intended to limit the invention of this application, which is as defined in the claims below.

That which is claimed is:

1. In a rotary distributor seal for a centrifuge which comprises a tubular housing having sealed ends, a relatively rotatable, fluid-containing apertured spindle coaxially mounted in said housing and projecting from an end thereof, and a plurality of resilient, spaced ring seals positioned about said spindle to seal the annular space between said spindle and the inner surface of said housing, and to subdivide said annular space into a plurality of axially spaced, annular chambers; and ports communicating with said chambers through said housing, to provide fluid flow paths from said ports to said separate chambers and through said spindle, the improvement comprising, support members positioned in alternate, spaced chambers between pairs of ring seals to prevent collapse of said ring seal pairs together, each support member comprising a rigid ring positioned about said spindle and spaced therefrom, a first opposed pair of sections of said ring occupying a first plane, and a second opposed pair of sections of said ring occupying a second plane.

2. The rotary distributor seal of claim 1 in which said spindle carries a transversely positioned cross bar to engage a stationary member during operation to prevent rotation of said spindle.

3. The rotary distributor seal of claim 2 which includes four resilient spaced ring seals to define four axially spaced, annular chambers.

4. The rotary distributor seal of claim 1 in which ball bearing means are provided to facilitate the relative rotation between said spindle and housing.

* * * * *